US010820627B2

(12) United States Patent
Jandron

(10) Patent No.: US 10,820,627 B2
(45) Date of Patent: Nov. 3, 2020

(54) CLOG RESISTANT BOWL FOR A WATER PIPE

(71) Applicant: John Brian Jandron, Vancouver, CA (US)

(72) Inventor: John Brian Jandron, Vancouver, CA (US)

( * ) Notice: Subject to any disclaimer, the term of this patent is extended or adjusted under 35 U.S.C. 154(b) by 270 days.

(21) Appl. No.: 15/721,935

(22) Filed: Oct. 1, 2017

(65) Prior Publication Data

US 2019/0098929 A1 Apr. 4, 2019

(51) Int. Cl.
*A24F 5/00* (2006.01)
*A24F 1/30* (2006.01)
*A24F 1/02* (2006.01)

(52) U.S. Cl.
CPC ..... *A24F 5/00* (2013.01); *A24F 1/02* (2013.01); *A24F 1/30* (2013.01)

(58) Field of Classification Search
CPC ..... A24F 5/00; A24F 5/04; A24F 5/06; A24F 5/08; A24F 5/10; A24F 7/00; A24F 9/00; A24F 1/28; A24F 1/30; A24F 1/02
See application file for complete search history.

(56) References Cited

U.S. PATENT DOCUMENTS 1,967,367 A * 7/1934 Paschal ..... A24F 5/04 131/198.2
1,967,438 A * 7/1934 Hartzes ..... A24F 1/30 131/173
3,106,922 A * 10/1963 Hefti ..... A24F 1/28 131/176
3,882,875 A 5/1975 Frost
4,044,781 A * 8/1977 Heggestuen ..... A24F 1/14 131/173
4,161,954 A 7/1979 Fornaciari
4,171,703 A * 10/1979 Locke ..... A24F 5/00 131/173
4,215,707 A 8/1980 Elrich
4,253,475 A * 3/1981 Schreiber ..... A24F 1/30 131/173
5,967,147 A * 10/1999 Newman ..... A24F 1/30 131/173
8,490,629 B1 * 7/2013 Shenassa ..... A24F 1/28 131/194
2007/0079839 A1 * 4/2007 Russon ..... A24F 1/30 131/173
2008/0072917 A1 * 3/2008 Lee ..... A24F 1/30 131/173

(Continued)

*Primary Examiner* — Kevin R Kruer
(74) *Attorney, Agent, or Firm* — Michael D. Eisenberg

(57) ABSTRACT

A smoking bowl for a water pipe comprised of a conical smoking chamber with a wide bottom aperture. The stem is inserted in a water pipe. At the base of the conical chamber is a narrow horizontal slit where a solid thin flat grate is inserted. When the grate is inserted it partially obscures the chamber's bottom aperture. A combustible material is placed in the chamber, with the grate engaged, and the material is smoked through the attached water pipe. When done smoking the grate is released from the chamber and the spent ash and resin is transmitted through the stem into the water pipe. The force of equalizing air pressure assists the transmittal of ash and resin. This action allows for heavy usage of the bowl before resin build up negatively affects the operation of this device.

1 Claim, 8 Drawing Sheets

(56) References Cited

U.S. PATENT DOCUMENTS

| | | | | |
|---|---|---|---|---|
| 2010/0126517 | A1* | 5/2010 | Groff | A24F 1/30 131/173 |
| 2013/0199546 | A1* | 8/2013 | Kahn, III | A24F 1/00 131/176 |
| 2014/0326256 | A1 | 11/2014 | Mckay | |
| 2014/0360513 | A1* | 12/2014 | Morgan | A24F 1/32 131/328 |
| 2016/0295911 | A1* | 10/2016 | Kalousek | A24F 1/30 |
| 2016/0302480 | A1* | 10/2016 | Rhoades | A24F 1/28 |

* cited by examiner

CLOG RESISTANT BOWL FOR A WATER PIPE

REFERENCE NUMERALS

Number 21, prior art stem inserted in water pipe.
Number 22, prior art narrow aperture.
Number 23, prior art underside aperture shelf.
Number 24, ignition chamber alignment groove.
Number 25, ignition chamber horizontal access port.
Number 26, ignition chamber wide bottom aperture.
Number 27, key handle.
Number 28, key handle reinforcement.
Number 29, key trigger.
Number 30, key spring.
Number 31, key arm.
Number 32, key grate.
Number 33, cage key hole.
Number 34, cage trigger lock.
Number 35, cage collar.
Number 36, stem a-ring assortment.
Number 37, closed grate.
Number 38, open grate.
Number 39, closed grate engaged in horizontal access port.
Number 40, closed key engaged in key lock.
Number 41, open key engaged in key hole and horizontal access port.
Number 42, cage flare holding key handle.
Number 43, standard glass water pipe chamber.
Number 44, standard glass water pipe downstem.

Number 45, closed clog resistant bowl engaged in a plain glass water pipe's downstem.
Number 46, open clog resistant bowl engaged in a plain glass water pipe's downstem.
Number 47, key grate held vertically.
Number 48, ignition chamber aligned with collar.
Number 49, stem removed from ignition chamber and removed from grate collar.
Number 50, cage keyhole aligned with extracted key.
Number 51, alternate embodiment stem.
Number 52, alternate embodiment grommet.
Number 53, alternate embodiment ignition chamber horizontal access port.
Number 54, alternate embodiment anchor.
Number 55, alternate embodiment backstop.
Number 56, alternate embodiment closed arm.
Number 57, alternate embodiment back board.
Number 58, alternate embodiment closed grate.
Number 59, alternate embodiment open arm.
Number 60, protruding mounting hole for a plain plastic water pipe.

The following descriptions only represent possible implementations and are not meant to limit the scope of this present invention.

This present invention is a bowl for a water pipe. The bowl has an ignition chamber, FIG. 3 and FIG. 4, designed for a single dose pipe load (generally ground herbal substances). In this implementation the ignition chamber is comprised of aluminum, but could be comprised of nickel, brass or steel. Glass or ceramics may be employed if metal threads are embedded in the bottom of the ignition chamber.

Figure 1:
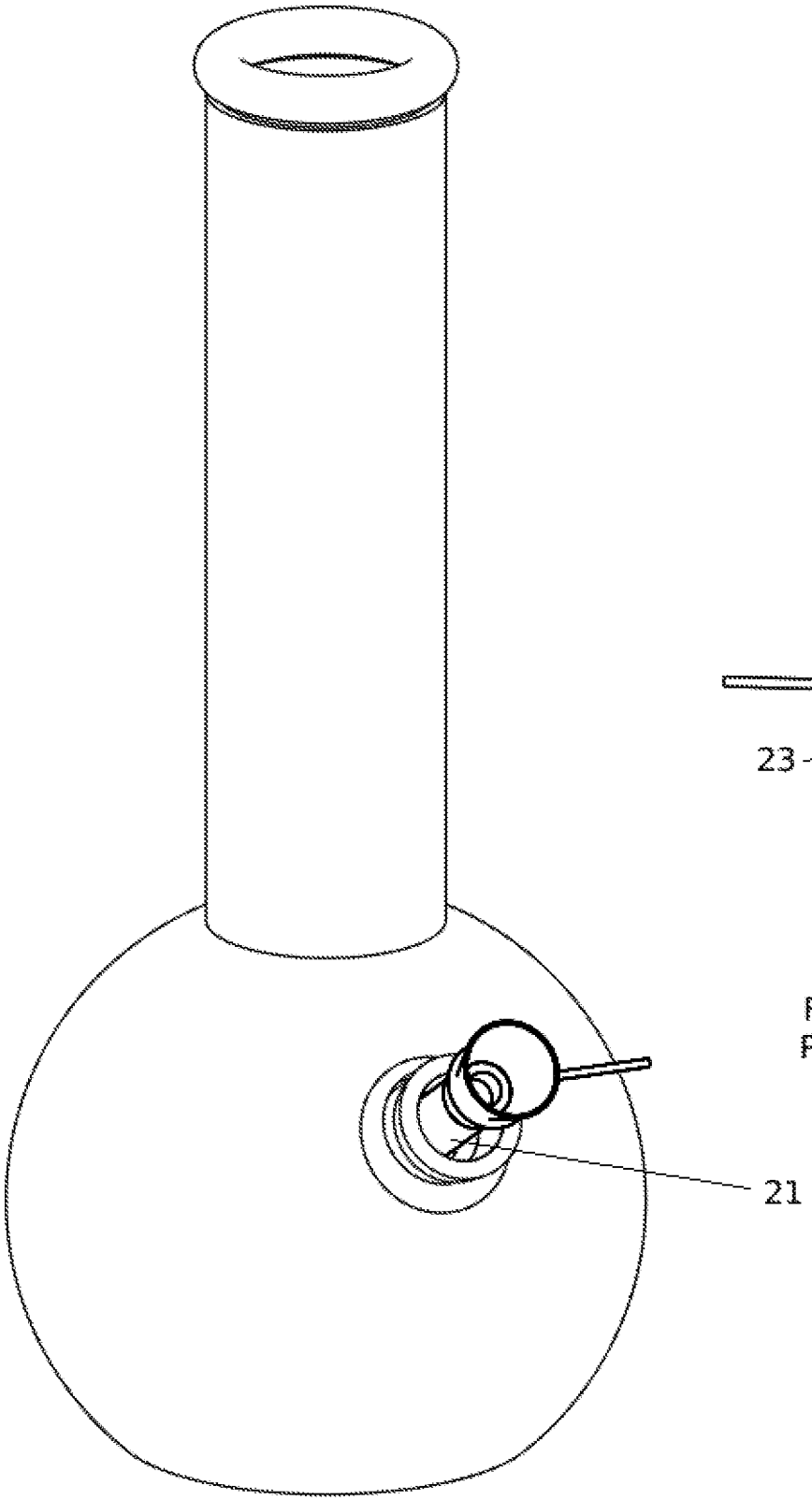
Figure 1 Prior Art
FIG. 1, is a prior art bowl inserted in downstem of a plain glass water pipe.
Figure 2:
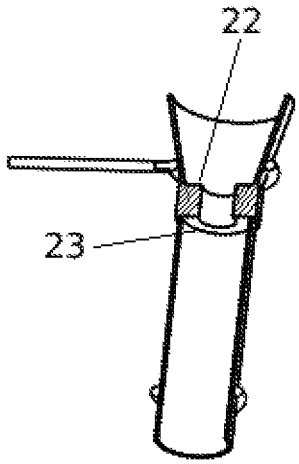
Figure 2 Prior Art
FIG. 2, is a cross section of prior art bowl for a water pipe.
Figure 3:
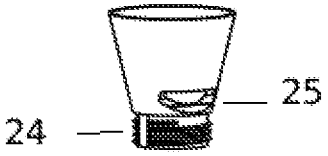
FIG. 3, front view of ignition chamber.
Figure 4:
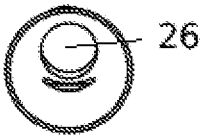
FIG. 4, top view of ignition chamber.

In this case the "v" shaped ignition chamber is employed, FIG. 3 and FIG. 4. The inside top of the ignition chamber has a radius of 8 mm and the bottom aperture radius is 4.6 mm, 26. The height of the ignition chamber is 18 mm total. The bottom 4 mm of the ignition chamber is threaded. At the bottom of the ignition chamber, 1 mm above the thread, a thin narrow horizontal access port, 25, is introduced, 2 mm wide and 8 mm long. The bottom of the access port is chamfered giving it rounded appearance. This access port is used to slide the grate, 32, on the key, FIG. 5, in and out of the ignition chamber. The left and right side of the thread is ground flat, the ignition chamber alignment groove, 24. It is 3 mm wide and ½ mm deep. It guides the ignition chamber alignment in the cage collar, 35.

Figure 5:
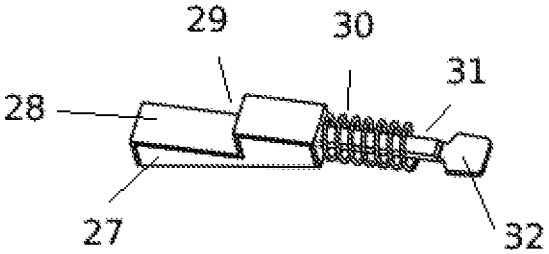
FIG. 5, side left perspective of key.

An appropriate heat resistant material is chosen for the grate, 32, and arm, 31. Various grades of steel (cold roll), brass (c464 naval brass), and aluminum (7075 T6 aircraft grade) have been successfully employed. The grate, 32, is 6 mm long by 5.5 mm wide by 0.75 mm thick and tapered inward at the top. The arm, 31, is 17 mm long by 2 mm wide by 1.5 mm thick. The key handle, FIG. 5, is 26 mm long and 6 mm wide. The key trigger lock, 29, is 11 mm long and 4.5 mm deep. The standard compression spring, 30, is 13 mm long with a radius of 3 mm. The key handle, 27, can be comprised of plastic or wood, must be reinforced with a suitable metal cover, 28, to prevent the key handle from breaking. This key handle cover also provides a solid edge to compress the key spring against the cage.

Figure 6:
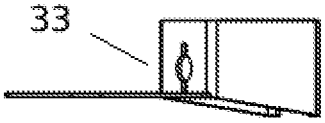
FIG. 6, front side perspective of cage.
Figure 7:
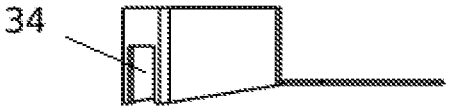
FIG. 7, back side perspective of cage.
Figure 8:
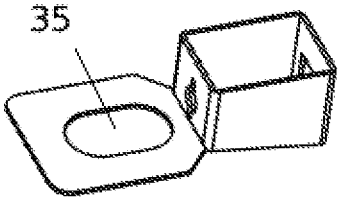
FIG. 8, top front perspective of cage.

The key, FIG. 5, is held in place by the cage, FIGS. 6, 7, and 8). The total length of the cage and cage collar is 40 mm long. The cage is 18 mm long and 12 mm wide. The cage collar is 22 mm long and 20 mm wide. The cage collar contains an elongated oval 9 mm wide and 15 mm long. The cage is comprised of aluminum, but steel or plastic can also be employed. The front of the cage is 10 mm tall and the back is 12 mm tall, yielding a slight flare downward, 42.

There is a small square hole in the back of the cage, the cage trigger lock, 34, which measures 8 by 8 mm. In the front of the cage is a small hole with a vertical slit in the middle, the cage key hole, 33. The cage key hole has a radius of 1.5 mm and the middle vertical slit is 1 mm wide by 7 mm long. The cage is held by the cage collar's elongated oval, 35, when it is inserted between the ignition chamber and stem's screw connection.

Figure 9:
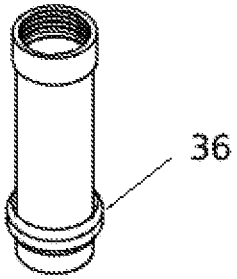
FIG. 9, top side perspective of stem.

The stem, FIG. 9, is made of aluminum and is 37 mm long with an inner radius of 4.8 mm. The top inside of the stem is threaded to accommodate the ignition chamber. The chosen assortment of o-rings, 36, is matched to the diameter of the downstem, 44. With the use of different sized a-rings the device can make a stable air tight connection with downstems of different diameters.

Figure 10:
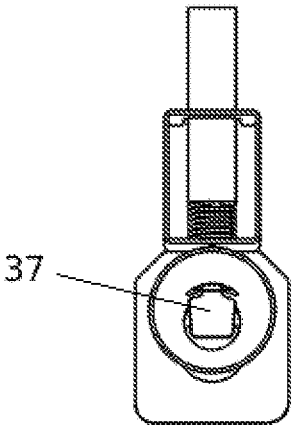
FIG. 10, top view of closed clog resistant bowl for a water pipe.
Figure 12:
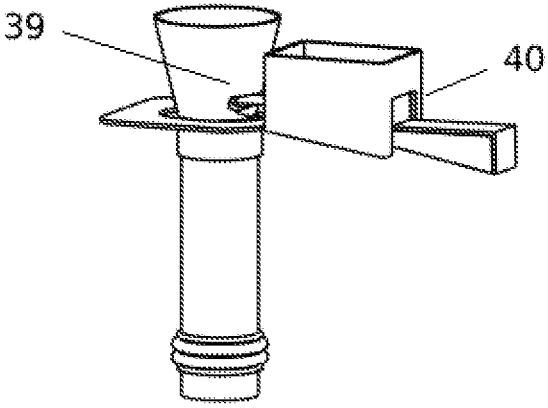
FIG. 12, back side view of closed clog resistant bowl for a water pipe.

The assembled device in a closed position, FIG. 10 and FIG. 12, detail how the grate holds the pipe load in place while covering 80% of the surface area of the bottom aperture, 37. According to user preference, the surface area of the grate can vary from 60% to 90% of the surface area of the bottom aperture. The lower the coverage the quicker the pipe load will burn, allowing larger single dose pipe loads. The grate is kept free of holes and slots to avoid excess ash and resin buildup. When the key is in the closed position the key trigger, 29, is engaged in the cage trigger lock, 34. The key spring, 30, is compressed against the inside of the cage key hole, 33. The diameter of the key hole can accommodate key arm, 31, but is narrow enough to stop and compress the key spring. When the key is closed, the grate holds the pipe load above the side access port, 39, preventing unwanted side venting. The key trigger engaged in the cage trigger lock, 40, retains the grate in the ignition chamber while in use. The user can end the smoking procedure, at any point, by pulling the key handle down. If the single dose pipe load was only partially smoked the key handle can still be pulled without clogging the device.

Figure 11:
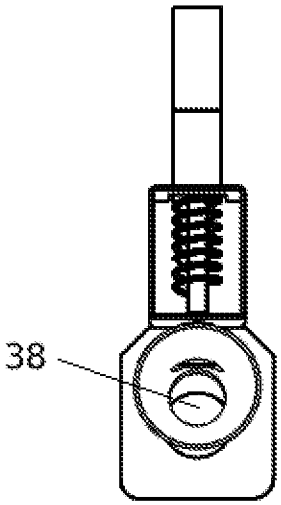
FIG. 11, top view of open clog resistant bowl for a water pipe.
Figure 13:
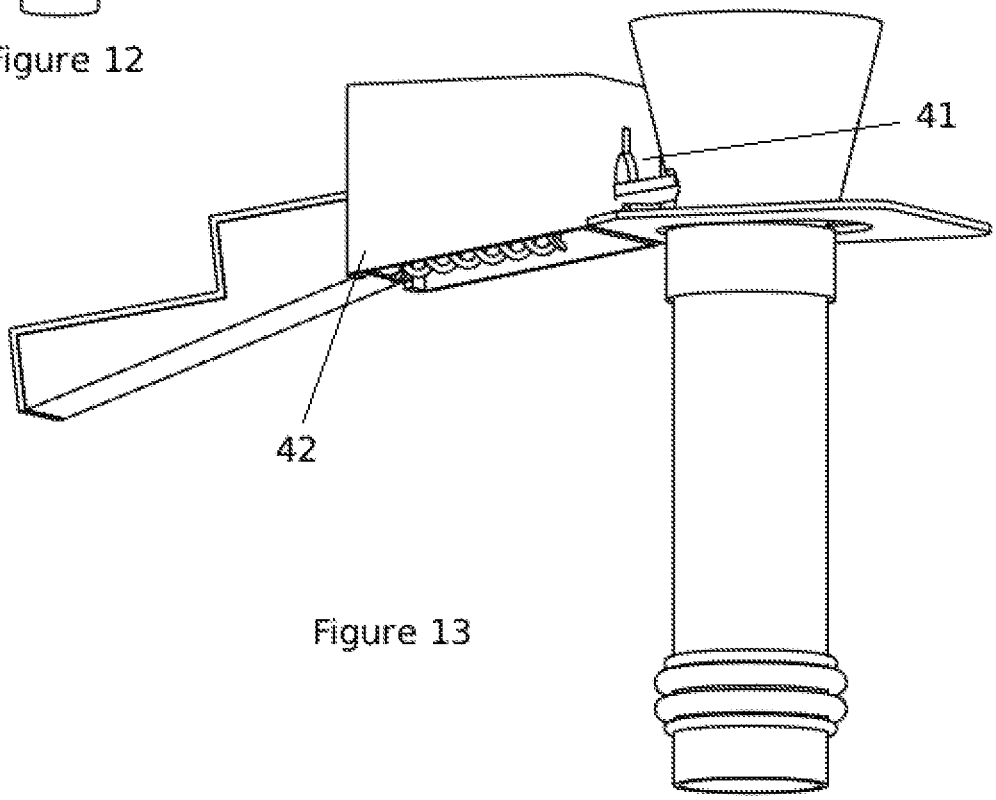
FIG. 13, front side view of open clog resistant bowl for a water pipe.

When the key is pulled out of the cage's trigger lock, the key's spring forces the key handle outward. This quickly pulls the key's arm and grate out of the ignition chamber's horizontal access port. The assembled device in an open position is detailed in FIG. 11 and FIG. 13. The full bottom aperture is exposed, 38, allowing a strong gust of equalizing air pressure. This gust pushes the spent pipe load through both the bottom aperture and the attached stem. When the key is open the tip of the grate stays inserted in the side access port. In this position the grate prevents burning embers from venting though this port. The cage's key hole and the top of the ignition chambers side access port firmly hold the key in place when the device is in the open position, 41. The cage has a slight flare downward, 42. This downward flare helps prevent the top of the key from accidentally catching under the cage.

Figure 14:
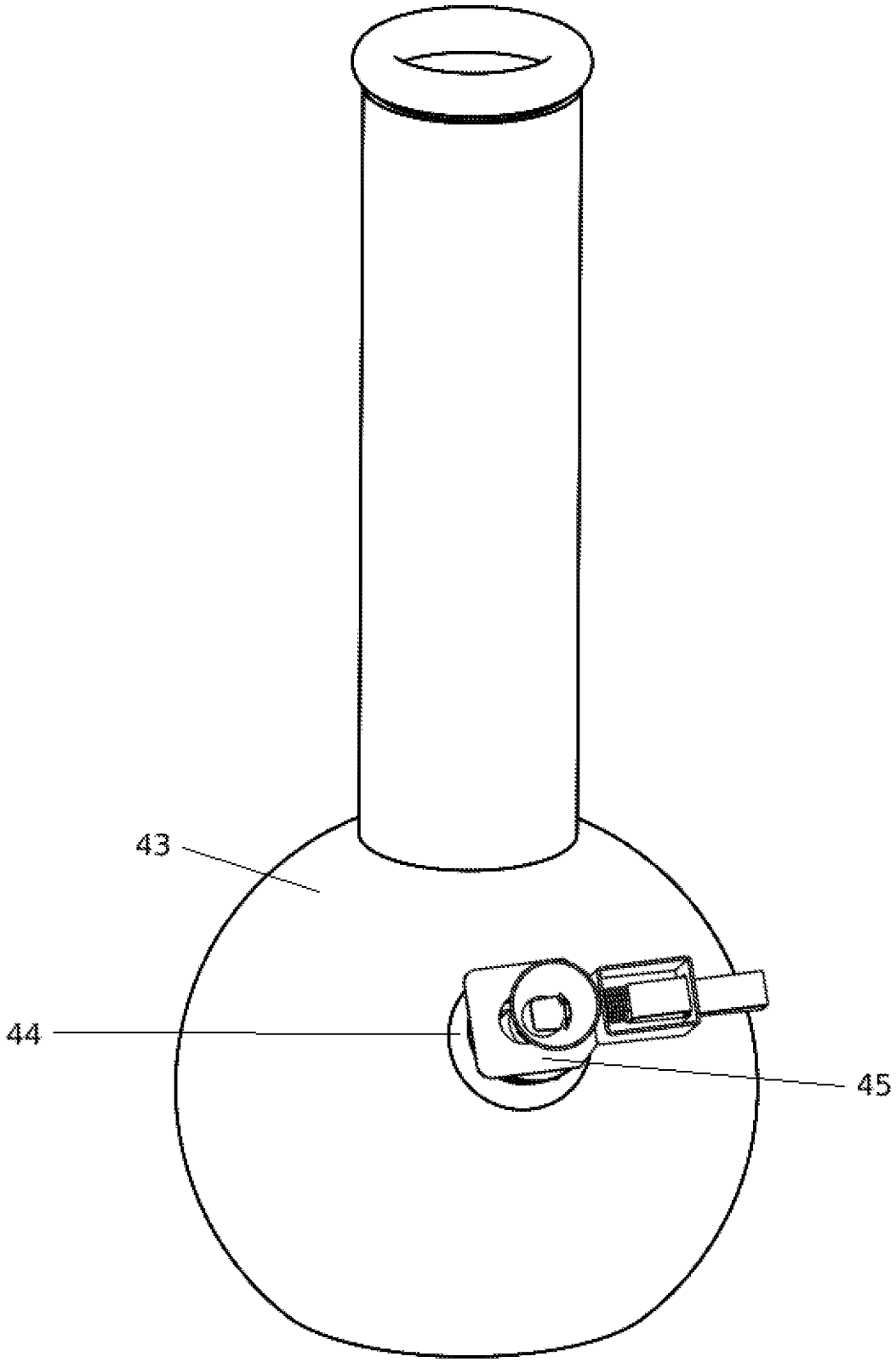
FIG. 14, front side view of closed clog resistant bowl inserted in the downstem of a plain glass water pipe.
Figure 15:
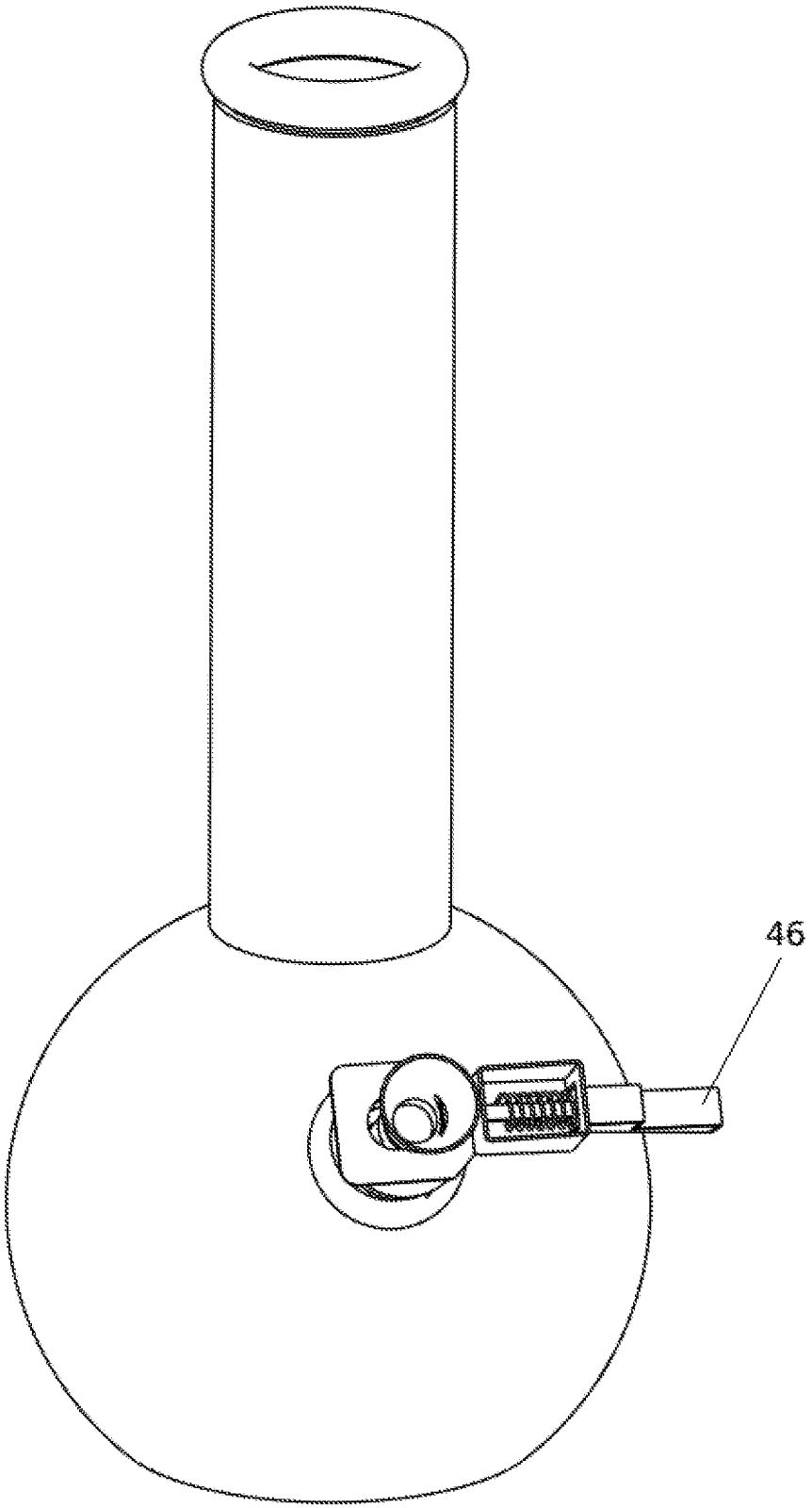
FIG. 15, front side view of open clog resistant bowl inserted in the downstem of a plain glass water pipe.

FIG. 14 depicts the anticipated usage of the closed clog resistant bowl for a water pipe, 45, inserted into the downstem, 44, of a standard glass water pipe. The chamber where the user creates a low pressure area is indicated by 43. FIG. 15 depicts the open clog resistant bowl, 46, inserted in a downstem of a standard glass water pipe.

Figure 16:
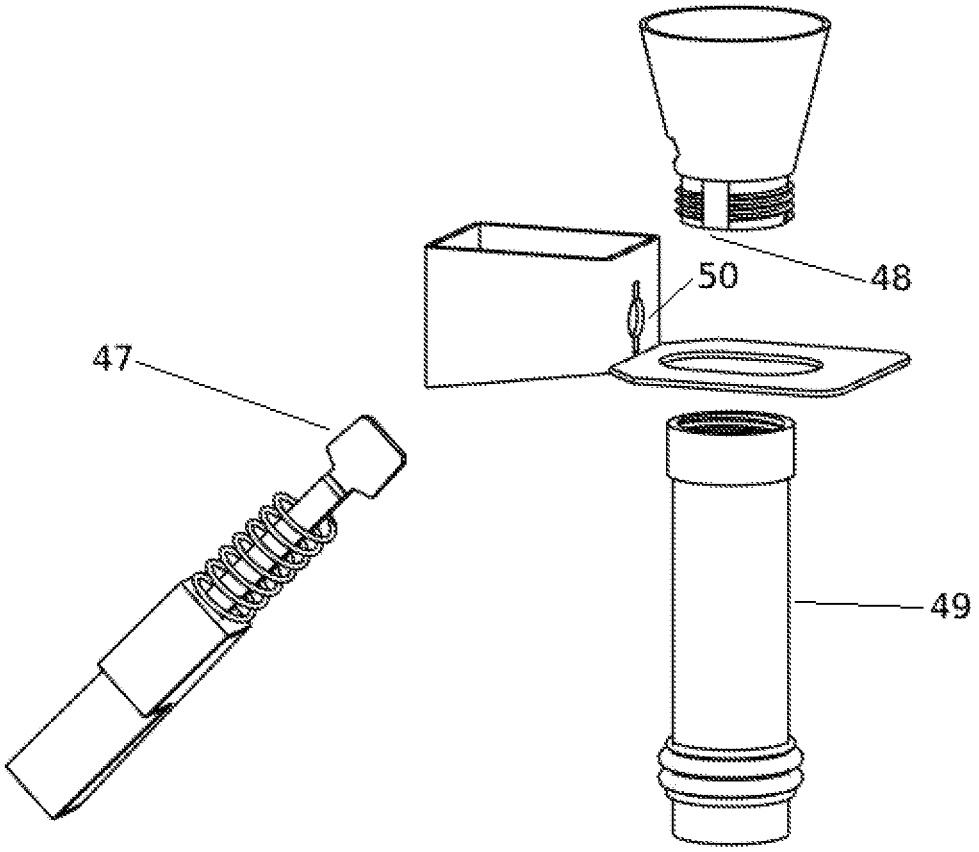
FIG. 16, exploded side view of components for the clog resistant bowl.

FIG. 16 details the components of the device in relation to each other. The ignition chamber is held in place by the collar because of the alignment grooves, 48. In general use, the stem only needs to be loosened, 49, allowing the stem and ignition chamber to be slid to the back of the cage collar while still loosely coupled. When the stem and ignition chamber are slid back, the key can be released by pulling the key handle downward and turning the key grate vertically. The key grate, 47, can then be slid out through the vertical slit in the cage's key hole, 50. The bowl, stem, and grate can now be easily accessed for cleaning after prolonged use.

Figure 20:
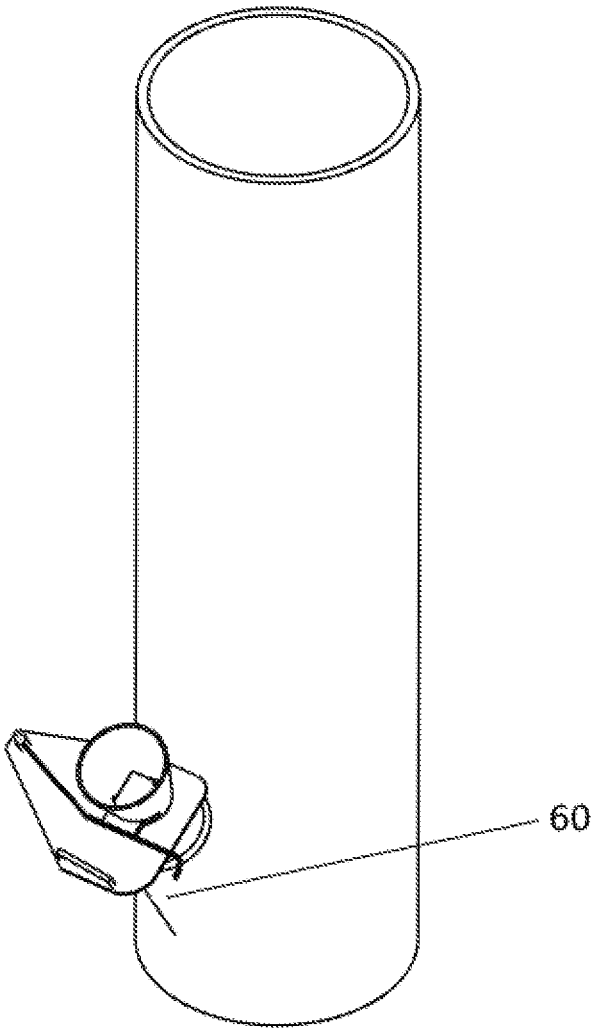
FIG. 20, front side view of alternate embodiment of clog resistant bowl mounted in a plain plastic water pipe.

Even though many specifics are detailed in the previous description, it should not be viewed as a limitation on the scope of other possible designs. Many other designs are possible. An alternate embodiment of the clog resistant bowl, that provides the same functionality for water pipes made from plastic, is depicted in FIG. 20. Plastic water pipes generally don't have downstems, they have a protruding hole, 60, for mounting a long aluminum stem, 51, through a mounted grommet, 52.

Figure 17:
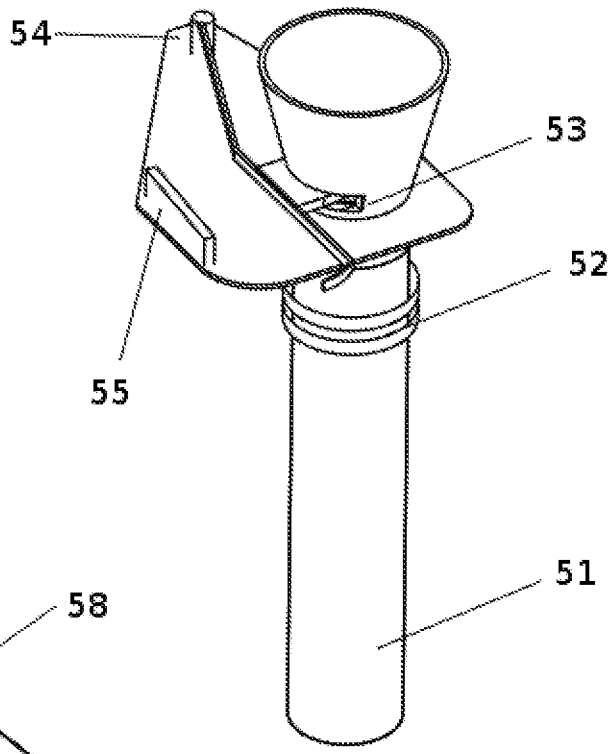
FIG. 17, upper side view of alternate embodiment of closed clog resistant bowl.
Figure 18:
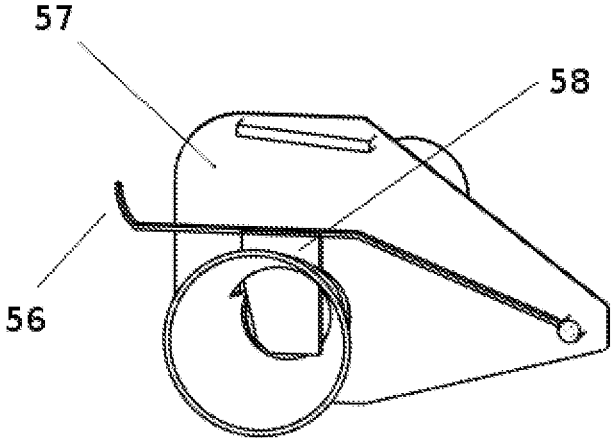
FIG. 18, top view of alternate embodiment of closed clog resistant bowl.
Figure 19:
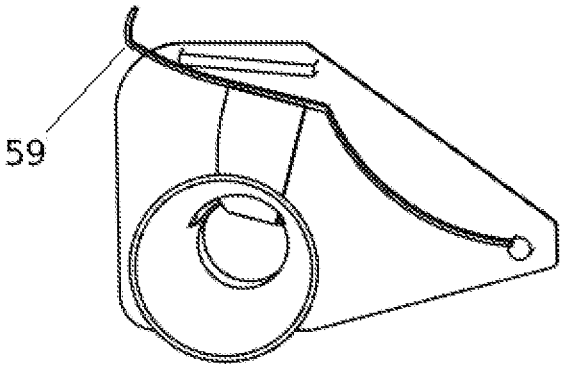
FIG. 19, top view of alternate embodiment of open clog resistant bowl.

This alternate embodiment is detailed in FIGS. 17, 18, and 19). The alternate embodiment has a stem, 51, that is 7 4 mm long and an inner radius of 4.8 mm. The top of the stem has internal threading. The "v" shaped ignition chamber has an inside top radius of 8 mm and the bottom aperture radius is 4.6 mm. The height of the ignition chamber is 18 mm total. The bottom 4 mm of the ignition chamber is threaded. At the bottom of the ignition chamber, 1 mm above the thread, a thin narrow horizontal access port is introduced, 2 mm wide and 9 mm long. The outside of the narrow horizontal access port has been elongated, 53, to accommodate the movement of grate, 58. The grate is attached to the arm, a thin spring tempered metal or other spring like material, that is 40 mm long, 56. The arm is welded onto an anchor, 54, which is in turn welded on to the back board, 57. The back board, 57, is 40 mm long by 25 mm wide, 1 mm thick. The back board is mounted between the stem and the ignition chamber's threaded connection. The anchor and back board can be made of metal or plastic. A small backstop, 2 mm high 11 mm long and 1 mm thick, is placed 8 mm behind the arm, 55, made of the same material as the back board. The grate, 58, is made of aluminum, 8 mm wide at the base, 10 mm long, and 0.75 mm thick. The grate is tapered on the outside edge, 6 mm distal width, the outside corner is cut short ½ mm.

The alternate embodiment is a normally closed device with the arm acting as a manual spring lever. When the arm is pulled it releases the grate and the pipe load from the ignition chamber, FIG. 19. A backstop is provided, to limit the motion of the arm, 59. This will help prevent the grate from being completely pulled out of the ignition chamber during regular use. Because the arm is made from spring like material, the arm will return to it's original shape placing the grate back to a closed position in the ignition chamber.

An additional embodiment, not depicted, considers the use of a micro solenoid to open a spring loaded normally closed grate style of clog resistant bowl.

The scope of the inventive subject matter, at hand, is not intended to be limited by the disclosed embodiments described above. The intended inventive scope would be determined by a comprehensive reading of the claims that follow.

What is claimed is:

1. A clog resistant smoking bowl attached to a water pipe, comprising:

a) an ignition chamber comprising a top and a bottom wherein said top comprises an aperture for loading combustible material and said bottom comprises an aperture, a threaded portion, and a horizontal opening positioned above said threaded portion wherein said horizontal opening is sized to allow a grate to be inserted into said ignition chamber;

b) a stem comprising a top and a bottom wherein the top inside of said stem is threaded to accommodate said threaded portion of the ignition chamber, and the bottom of said stem comprises an o-ring or grommet to accommodate a connection to said water pipe;

c) a key comprising a grate which is free of holes and slots and covers 60-90% of the surface area of said bottom aperture;

an arm attached to said grate;

a compression spring coiled around said arm; and a key handle attached to said arm opposite said grate wherein said key handle is reinforced with a metal cover to prevent the key handle from breaking;

d) a housing comprising a collar comprising an elongated oval which is inserted between said ignition chamber and said stem in order to hold said housing, and a box comprising a front wall and a back wall wherein said back wall comprises a trigger lock hole and said front wall comprises a key hole; and e) wherein said key is positioned relative to said housing such that the grate passes through the key hole, said compression spring is positioned between said front wall and said back wall, and said key handle is positioned outside said back wall such that the spring is compressed against the inside of the key hole and the grate is positioned to cover said 60-90% of said surface area of said bottom aperture when said key is engaged with said trigger lock hole and wherein said compression spring forces said key toward said back wall of said box and said grate is retracted from said ignition chamber when said key is not engaged with said trigger lock hole thus transmitting said combustible material through said stem into said water pipe.

* * * * *